US008578906B2

(12) United States Patent
Yamada et al.

(10) Patent No.: US 8,578,906 B2
(45) Date of Patent: Nov. 12, 2013

(54) OIL SYSTEM FOR AN ENGINE

(75) Inventors: Shuya Dan Yamada, Novi, MI (US); David Matthew Gasior, Livonia, MI (US); Edward William Peters, Novi, MI (US); Dallis Sun, Troy, MI (US); Karl Robert Klomp, Clinton Township, MI (US); Michael David Deegan, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 181 days.

(21) Appl. No.: 13/181,871

(22) Filed: Jul. 13, 2011

(65) Prior Publication Data

US 2013/0014726 A1 Jan. 17, 2013

(51) Int. Cl.

| | |
|---|---|
| ***F01M 9/10*** | (2006.01) |
| ***F01M 5/00*** | (2006.01) |
| ***F01M 3/04*** | (2006.01) |

(52) U.S. Cl.
USPC ..... 123/196 R; 123/196 AB; 123/196 CP

(58) Field of Classification Search
USPC ..... 123/196 R, 196 AB, 195 C
See application file for complete search history.

(56) References Cited

U.S. PATENT DOCUMENTS

| | | | | |
|---|---|---|---|---|
| 1,528,655 | A | 3/1925 | Christian et al. | |
| 3,211,256 | A | 10/1965 | Teutsch | |
| 4,276,859 | A * | 7/1981 | Streicher et al. | 123/196 R |
| 4,354,521 | A | 10/1982 | Harde | |
| 4,616,609 | A * | 10/1986 | Munch et al. | 123/196 AB |
| 4,986,235 | A | 1/1991 | Ishii et al. | |
| 5,469,822 | A * | 11/1995 | Mechsner | 123/195 C |
| 5,937,817 | A | 8/1999 | Schanz et al. | |
| 6,234,136 | B1 * | 5/2001 | Choi et al. | 123/195 C |
| 6,340,012 | B1 * | 1/2002 | Yamashita et al. | 123/195 C |
| 6,415,942 | B1 | 7/2002 | Fenton et al. | |
| 6,786,350 | B2 | 9/2004 | Bauer | |
| 7,017,546 | B1 | 3/2006 | Patel et al. | |
| 7,134,568 | B2 | 11/2006 | Moriyama et al. | |
| 7,171,937 | B2 * | 2/2007 | Hada et al. | 123/195 C |
| 7,240,657 | B2 | 7/2007 | Watanabe | |
| 7,341,039 | B1 | 3/2008 | Jaszewski et al. | |
| 7,481,196 | B2 * | 1/2009 | Jessberger | 123/195 C |
| 2009/0078705 | A1 | 3/2009 | Ramsay | |

FOREIGN PATENT DOCUMENTS

| | | | |
|---|---|---|---|
| DE | 19650415 | A1 | 6/1998 |

* cited by examiner

*Primary Examiner* — Lindsay Low
*Assistant Examiner* — Charles Brauch
(74) *Attorney, Agent, or Firm* — Julia Voutyras; Alleman Hall McCoy Russell & Tuttle LLP

(57) ABSTRACT

A system for an internal combustion engine is provided. The system includes an oil pan, a pick up tube; and a spacer. The spacer is positioned vertically above a static oil level and secured to a surface of the oil pan. Further, the spacer may include an opening that may communicate with oil when the oil is in a tilt orientation.

20 Claims, 4 Drawing Sheets

OIL SYSTEM FOR AN ENGINE

BACKGROUND AND SUMMARY

Internal combustion engines of a vehicle may use internal plates or baffles to block or redirect fluids.

For example, U.S. Pat. No. 4,986,235 describes a system for an oil pan of an internal combustion engine. The system includes one or more guide plates that may be coupled to one internal side surface of the oil pan. The guide plates collect oil splashed towards the internal side surface and return the oil to the oil pan. Therefore, oil kicked out by the crankshaft can be returned to the suction device.

The inventors herein have recognized various issues with the above system. In particular, the guide plates do not collect oil on all side surfaces of the oil pan. Therefore, oil splashed to other internal side surfaces may not be effectively returned to the oil pan. For example, oil may creep up other internal side surfaces due to extreme vehicle maneuvers that can occur in various directions, as opposed to the single rotational direction of the crankshaft.

As such, one example approach to address the above issues is to provide a spacer that can displace oil that splashes or creeps up each internal side surface back to a suction device. In this way, it is possible to maintain oil in the oil pan near the pick-up location. Specifically, the spacer may displace and direct oil such that it is concentrated within a suction region of the oil pan. This configuration enables the pickup tube to maintain proper fluidic communication with the oil, even during sustained extreme vehicle maneuvers. Further, by taking advantage of concentrating oil within the suction region, the prevalence of air bubbles distributed throughout the oil delivery system can be reduced.

Note that various spacer geometric configurations may be employed to maintain fluidic communication between the pickup tube and the oil. Further, various baffle plates may be additionally included to direct oil towards the suction region, if desired.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to an oil containment system for an internal combustion engine. The oil containment system is arranged in such a way that oil is maintained within a suction region surrounding an inlet of an oil pickup tube even during extreme vehicle maneuvers. This arrangement allows the vehicle to sustain extended extreme maneuvers such as high gravitational force accelerations, decelerations, and turns while reducing the occurrence of air bubbles within an oil delivery system due to inadequate fluidic communication that may occur between the pickup tube and the oil. For example, extreme maneuvers may be associated with professional racecar driving, high-speed emergency vehicle driving, etc. Various spacers for redirecting oil under such conditions may be included in the disclosed system. For example, a spacer may be secured to an interior surface of an oil pan above a static oil level. In some scenarios, the spacer may not be in fluid communication with the static oil level during normal vehicle operation (e.g., non-extreme vehicle maneuvers typical of every day driving). In other scenarios that may be referred to herein as extreme driving maneuvers, an outer surface of the spacer may be in fluid communication with the oil in order to displace and redirect the oil such that a sufficient oil level is maintained within the suction region and in communication with a pick-up tube inlet. The oil containment system may utilize a spacer in different ways; for example, by allowing oil to pass through an opening of the spacer, by obstructing oil flow from advancing past an upper surface of a spacer, and redirecting oil flow back to a suction area coinciding with a pick up tube. Additionally, the oil containment system may include various baffle plates to further direct oil flow.

Figure 1A:
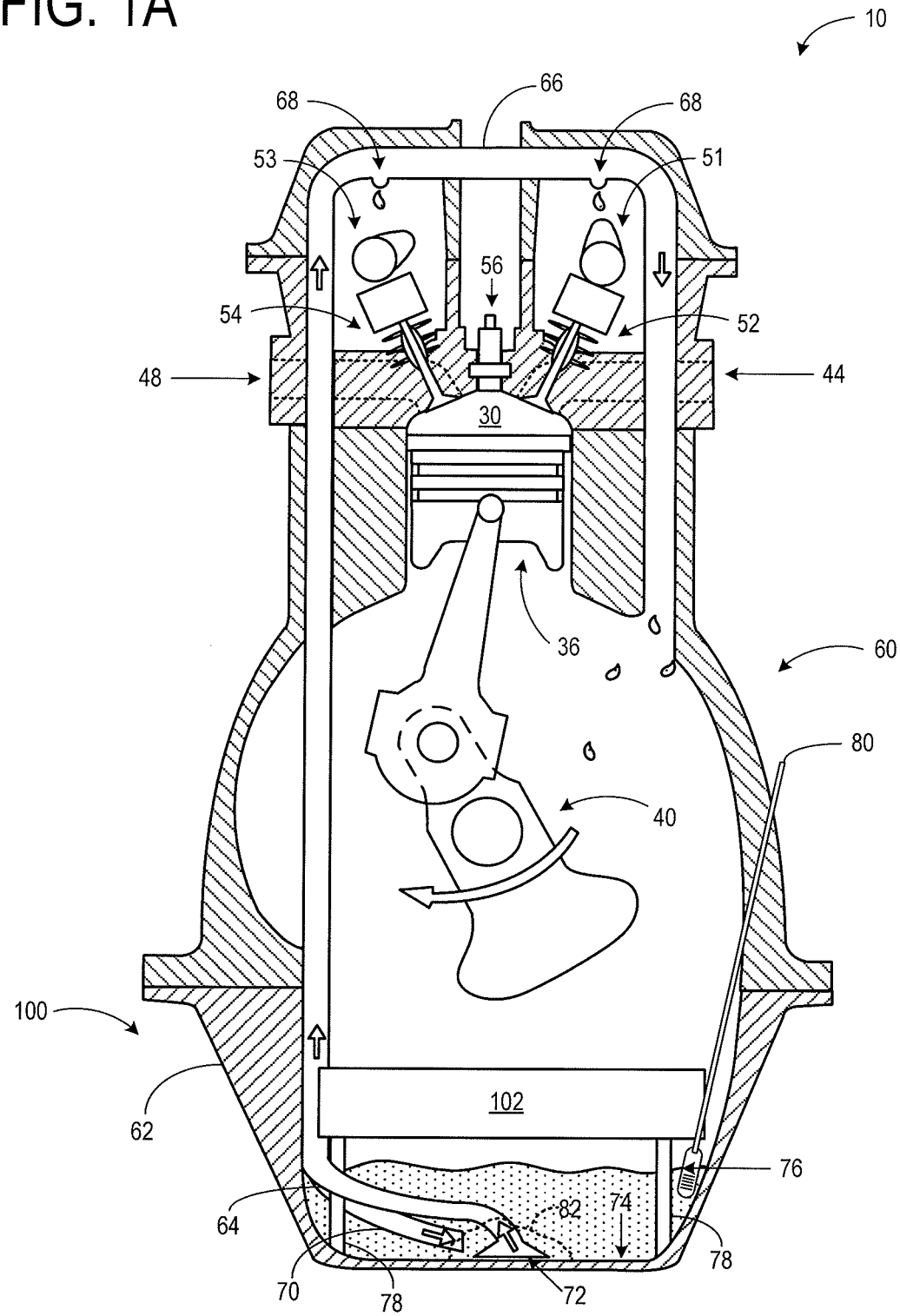
FIG. 1A is a schematic diagram of an example internal combustion engine including an oil containment system according to an embodiment of the present disclosure.
Figure 1B:
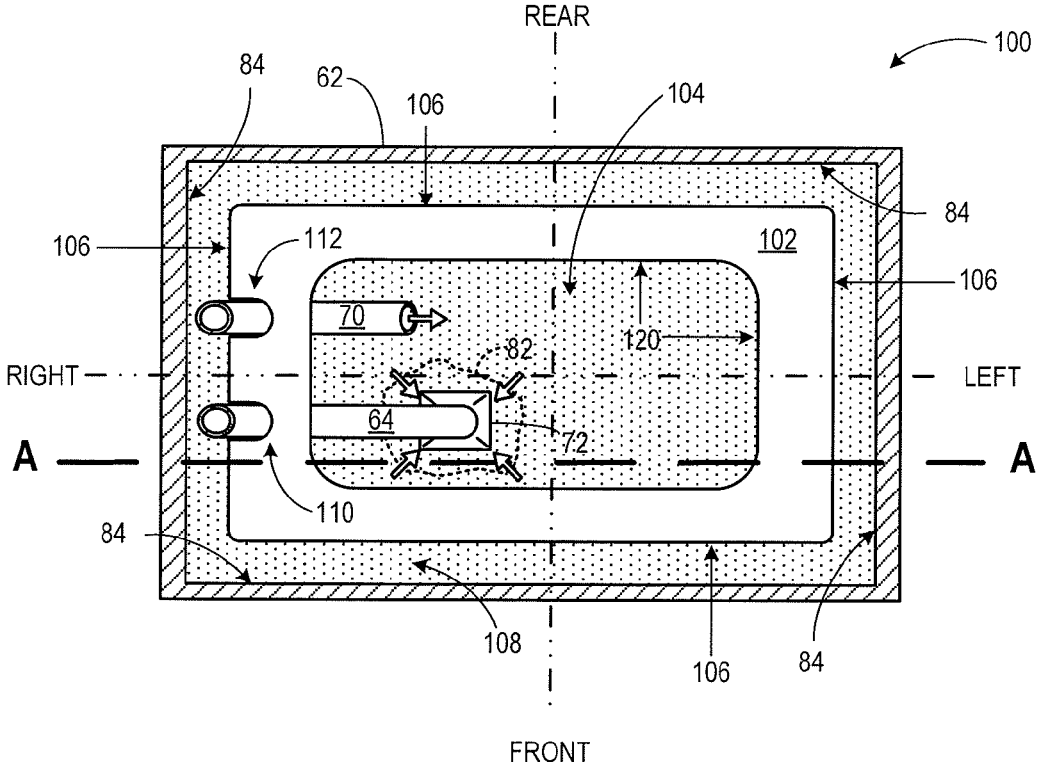
FIG. 1B is a top view of the example oil containment system of FIG. 1A.
Figure 1C:
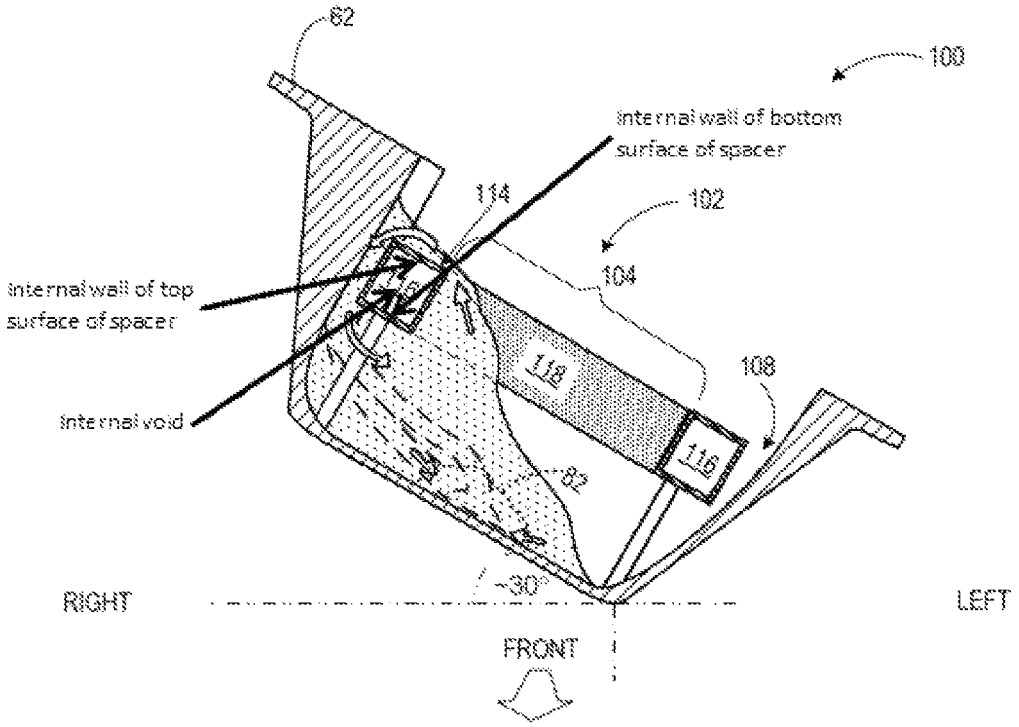
FIG. 1C is a cross sectional view of the example oil containment system of FIG. 1B in a tilt orientation.
Figure 2A:
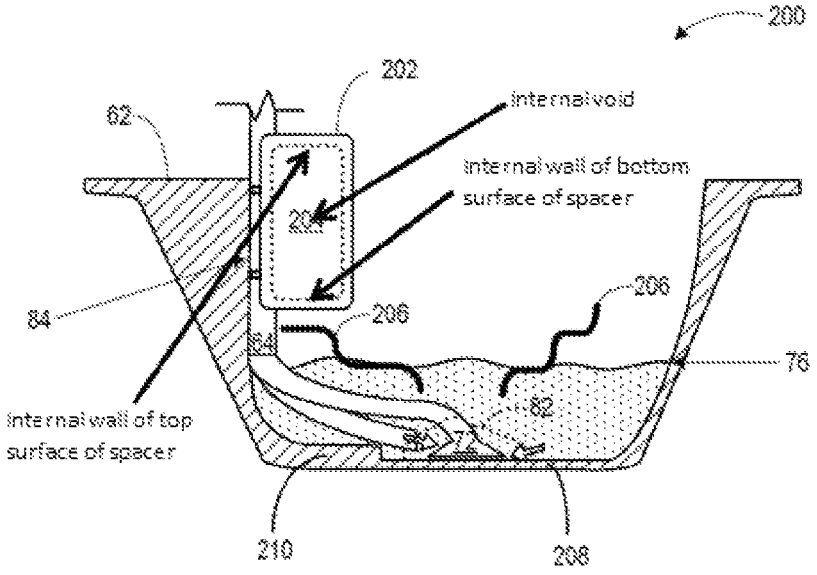
FIG. 2A is a schematic diagram of another example oil containment system according to an embodiment of the present disclosure.
Figure 2B:
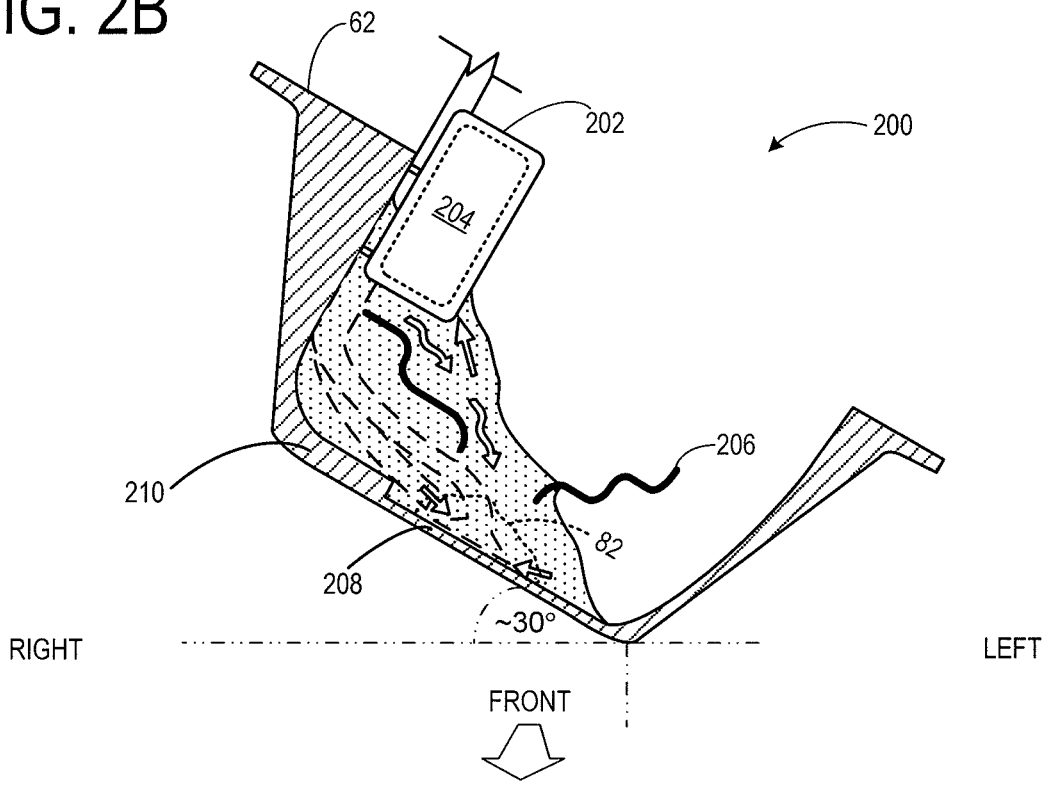
FIG. 2B is a schematic diagram of the example oil containment system of FIG. 2A in a tilt orientation.

An example engine including an oil containment system is depicted in FIG. 1A. FIG. 1B shows a top view of the example oil containment system of FIG. 1A. FIG. 1C shows a cross sectional view of the example oil containment system of FIG. 1B in a tilt orientation. FIG. 2A is a schematic diagram of another example oil containment system according to an embodiment of the present disclosure. FIG. 2B is a schematic diagram of the example oil containment system of FIG. 2A in a tilt orientation.

Referring specifically to FIG. 1A, it includes a schematic diagram showing one cylinder of multi-cylinder internal combustion engine 10. Engine 10 may be controlled at least partially by a control system and by input from a vehicle operator via an input device such as an accelerator pedal (not shown).

Combustion cylinder 30 of engine 10 may include combustion cylinder walls with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Wet sump crankcase 60 may house crankshaft 40. Further, crankcase 60 may be coupled to oil pan 62. Crankcase 60 may enable lubrication of crankshaft 40 to permit fluidic reciprocating motion. Oil may be suctioned from oil pan 62 by pickup tube 64 and delivered to an oil pump (not shown) in order to be distributed throughout the oil delivery system. Oil may drip from an overhead oil delivery passage 66 to lubricate crankshaft 40. In the example shown, oil delivery passage 66 may be continuous with pickup tube 64, which is in fluid communication with oil pan 62. Further, oil may drip from one or more outlets 68 to lubricate other rotating components. For example, outlets 68 may feed oil dropwise to lubricate camshafts and other drive shafts. Oil may gravity feed from crankshaft 40 and other rotating components and return to oil pan 62. In some examples, oil may be returned to oil pan 62 via an oil return passage 70. Oil return passage may be in fluid communication with one or more oil collection devices (not shown) to channel oil flow to return passage 70. In this way, oil may be cycled through engine 10 such that rotating components are effectively lubricated to enable the four stroke combustion cycle.

Combustion cylinder 30 may receive intake air from intake manifold 44 via an intake passage and may exhaust combustion gases via exhaust passage 48. Intake manifold 44 and exhaust passage 48 can selectively communicate with combustion cylinder 30 via respective intake valve 52 and exhaust valve 54. In some embodiments, combustion cylinder 30 may include two or more intake valves and/or two or more exhaust valves.

In this example, intake valve 52 and exhaust valve 54 may be controlled by cam actuation via respective cam 51 and 53. Cam 51 and 53 may be actuated via cam profile switching (CPS), variable cam timing (VCT), variable valve timing (VVT) and/or variable valve lift (VVL) systems that may be operated by a controller to vary valve operation. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 56 is shown coupled directly to combustion cylinder 30 for injecting fuel directly therein. The fuel injector may be mounted on the side of the combustion cylinder or in the top of the combustion cylinder, for example. Fuel may be delivered to fuel injector 56 by a fuel delivery system (not shown) including a fuel tank, a fuel pump, and a fuel rail. In some embodiments, combustion cylinder 30 may alternatively or additionally include port fuel injection into the intake port upstream of combustion cylinder 30. In this way, fuel may be delivered to combustion cylinder 30 to be ignited via compression, such as in diesel engines, or via a spark plug (not shown).

Engine 10 may further include oil containment system 100 to reduce the occurrence of air bubbles in pickup tube 64. As introduced above, pickup tube 64 may be more susceptible to suctioning air during extreme vehicle maneuvers when oil sloshing against the oil pan inner surfaces may aerate the oil, for example. As another example, high gravitational forces due to rapid acceleration, rapid deceleration, and/or sustained short radius turns resulting in high centripetal forces may force oil to one side of the oil pan which may expose suction inlet 72 to air. In this way, the oil level may be tilted with respect to the bottom surface of the oil pan. Said in another way, the surface oil level may be non-parallel to the bottom surface of the oil pan. In this scenario, it will be appreciated that the oil level may be tilted even though the vehicle may be traveling on a level surface. As yet another example, vehicles traveling on banked surfaces such as racecars cornering around a banked turn may result in a tilt orientation in which oil pan 62 is tilted at an angle. Said in another way, the oil pan may be tilted due to the vehicle traveling on a non-level surface, thus resulting in a tilted oil level for such a turn maneuver. For example, a banked corner may be angled at 30 degrees from the horizontal, and thus the oil pan may be angled at 30 degrees from the horizontal. Oil containment system 100 may ensure lubrication even during extreme vehicle maneuvers.

As shown, oil containment system 100 may include oil pan 62, pickup tube 64, and spacer 102. As introduced above, pickup tube 64 may maintain fluidic communication with oil in order to deliver the oil to an oil pump for distribution throughout the engine. As such, pickup tube 64 may include an inlet 72 that hovers in close proximity to a bottom surface 74 of oil pan 62. Inlet 72 may suction oil from bottom surface 74 for delivery to the oil pump (not shown). Therefore, inlet 72 may maintain fluidic communication with the oil. Inlet 72 may be associated with an oil filter (not shown) to prevent unwanted particles from entering the oil delivery passage. Further, inlet 72 may have a funnel-like shape having a greater cross sectional area than pickup tube 64 to facilitate suction from a greater area of bottom surface 74. The funnel-like shape may be rectangular or circular, for example. In other examples, inlet 72 may have a cross sectional area smaller than the cross sectional area of the pickup tube. In yet other examples, inlet 72 may have a cross sectional area substantially equal to that of pickup tube 64.

As shown, inlet 72 may be submerged within the oil such that inlet 72 is below static oil level 76. However, the oil level may change in some scenarios. In particular, the oil may be forced to a side of oil pan 62 during extreme vehicle maneuvers, as described above. As a result, inlet 72 may be exposed to air due to a break in fluidic communication with the oil and/or air bubbles may be introduced into the oil due to sloshing against the internal surfaces. Excessive air within the oil delivery system may be detrimental to the engine. For example, too little oil may result in poorly lubricated drive shafts. As another example, sucking up air may result in oil pressure fluctuations and engine frictional losses. To reduce the likelihood of sucking up air during such conditions, oil containment system 100 may include spacer 102 in order to at least in part, maintain proper fluidic communication between inlet 72 and the oil.

Spacer 102 may be secured to bottom surface 74 via one or more vertical run down bolts 78. As such, bolts 78 may pass through a bottom surface of spacer 102. For example, bolts 78 may pass through a bottom surface of spacer 102 proximate to a corner of spacer 102. In one example, spacer 102 may be secured to bottom surface 74 with four bolts, wherein each corner of spacer 102 includes a bolt passing through the bottom surface of the spacer. In this way, spacer 102 may be positioned vertically above static oil level 76. As such, under normal operating conditions (e.g., during non-extreme vehicle maneuvers), spacer 102 may not be in fluidic communication with the oil. Conversely, dipstick 80 may be in fluid communication with the oil during normal operating conditions. Therefore, dipstick 80 may be in communication with the static oil level and spacer 102 may be positioned above the static oil level. Said in another way, a bottom surface of spacer 102 may be positioned vertically above a bottom insertion end of dipstick 80. However, as described below, during extreme vehicle maneuvers, spacer 102 may be in fluidic communication with the oil.

Some prior solutions have incorporated various baffles such that the baffles remain in contact with the oil even during normal driving conditions. Said in another way, under normal driving conditions, baffles well known in the art are at least partially submerged within the oil such that the baffles are located below a static oil level. However in extreme driving conditions, these baffles which are often thin plated baffles, are ineffective in ensuring fluidic communication between the pickup tube inlet and the oil. This is primarily because a thin baffle plate does not displace enough oil and therefore is ineffective in concentrating oil over a suction region. Instead, oil may creep up one or more internal side surfaces, thus risking inlet exposure to air.

To maintain fluidic communication and reduce inlet exposure to air, some solutions may include increasing the oil level such that the inlet cannot be exposed to air even when gravitational and/or lateral acceleration forces pull the oil to a side of the oil pan. However, raising the oil level will push the oil level closer to the rotating components, such as the crankshaft. This too may cause excessive oil aeration from the crankshaft plunging into the high static oil level, which may lead to engine friction loss as well as potential engine failure.

The spacer described herein circumvents the aforementioned issues. By positioning spacer 102 above a static oil level, oil may be displaced under lateral and longitudinal gravitational force movements to concentrate oil within the suction region, yet the spacer may not be in contact with oil during normal vehicle maneuvers. Therefore in addition to reducing the potential for oil to uncover the pickup tube inlet and thus reducing the potential of exposing the inlet to air, the spacer does not raise the oil level during normal vehicle maneuvers. Therefore, it is possible to provide a spacer of substantial thickness to displace an adequate amount of oil to ensure fluidic communication without raising the static oil level since the spacer is positioned above the static oil level during normal vehicle maneuvers.

As described above, FIG. 1A shows only one cylinder of a multi-cylinder engine, and each cylinder may similarly include its own set of intake/exhaust valves, fuel injector, ignition system, etc. Further, each cylinder may be coupled to an oil containment system to ensure proper fluidic communication even during extreme vehicle maneuvers.

Turning to FIG. 1B, a top view of oil containment system 100 including spacer 102 is illustrated. As shown, spacer 102 may include flow-through opening 104 positioned vertically above inlet 72 of pick up tube 64. In other words, flow-through opening 104 may be surrounded by vertical walls of spacer 102. As such, spacer 102 may have a frame-like structure including an opening positioned vertically above a suction region 82 and wherein the frame-like body of spacer 102 covers a region surrounding a suction region 82 from above. Therefore in the illustrated example, flow-through opening 104 may extend beyond a boundary of suction region 82, thus framing suction region 82 within a portion of flow-through opening 104. In other words, flow-through opening 104 may have a cross sectional area that is greater than suction region 82.

Suction region 82 may be a region that coincides with inlet 72. For example, suction region 82 may be a volumetric region surrounding inlet 72. As such, suction region 82 may represent a general spatial area, that when occupied with oil, allows for proper fluidic communication between inlet 72 and the oil.

Therefore, flow-through opening 104 may be positioned above suction inlet 72. It will be appreciated that flow-through opening 104 may frame inlet 72 (and likewise suction region 82) within any portion of flow-through opening 104. As shown, inlet 72 is framed within a front-right quadrant, wherein front indicates a front of the vehicle and right indicates a ride side of the vehicle from a driver's perspective. Inlet 72 may be positioned such that inlet 72 is framed by flow-through opening 104 within another region. For example, inlet 72 may be positioned within front-left quadrant, rear-left quadrant, or rear-right quadrant. In another example, inlet 72 may include portions positioned within two or more quadrants.

Further, flow-through opening 104 may include void portions that coincide with one or more of the aforementioned quadrants. In the illustrated example, flow-through opening 104 includes void portions that coincide with each quadrant. In other examples, flow through opening 104 may include fewer void portions. Furthermore, flow-through opening may be another shape than the rounded corner rectangle illustrated in FIG. 1B. For example, flow-through opening may form a circular shaped void. As another example, flow-through opening may form an irregular shaped void. Further, there may be more than one flow-through opening.

As shown in FIG. 1B, perimeter surfaces 106 of spacer 102 may follow a general perimeter of the interior side walls 84 of oil pan 62. Perimeter surfaces 106 may be at least a predetermined distance form interior side walls 84. As one example, perimeter surfaces 106 may be approximately 10 millimeters from side walls 84. However, other distances between perimeter side surfaces 106 and side walls 84 are possible without departing from the scope of this disclosure. For example, the distance may be greater than 10 millimeters. As another example, the distance may be fewer than 10 millimeters. Further, it will be appreciated that the distance between the perimeter surfaces and the interior side walls may vary. For example, the distance between one perimeter surface and a corresponding interior side wall may be different than a distance between a second perimeter surface and a corresponding interior side wall. Further, it will be appreciated that the perimeter surfaces and/or the interior side walls may form an irregular shape. For example, the perimeter surfaces and/or the interior side walls may have one or more recessed areas and/or protrusions.

Further, a perimeter space 108 may be formed between spacer 102 and interior side walls 84. In other words, perimeter space 108 may be adjacent and spaced away from interior side walls 84. Perimeter space 108 may occupy a smaller cross sectional area than flow-through opening 104. In another example, perimeter space 108 may occupy a greater cross sectional area than flow-through opening 104. In yet another example, perimeter space 108 and flow-through opening 104 may occupy spaces that are equal in cross sectional area.

Spacer 102 may further include a void 110 to accommodate pickup tube 64 and a void 112 to accommodate a return tube 70. In this way, oil may be suctioned from oil pan 62 and returned to oil pan 62. As shown, portions of pickup tube 64 and return tube 70 may be located below spacer 102. For example, pickup tube 64 and return tube 70 may include horizontal portions positioned below spacer 102, as best shown in FIG. 1A. Said in another way, pickup tube 64 and return tube 70 may include portions positioned between the bottom surface of oil pan 62 and spacer 102. Voids 110 and 112 may enable other portions of pickup tube 64 and return tube 70 to extend vertically. In this way, pickup tube 64 and return tube 70 may pass under spacer 102 and up interior side walls 84. As such, pickup tube 64 and return tube 70 may not pass through flow-through opening 104. Instead, pickup tube 64 and return tube 70 may pass through voids 110 and 112 respectively, wherein voids 110 and 112 are distinctly separate each other and from flow-through opening 104. However, in some embodiments voids 110 and 112 may coalesce with the space created by flow-through opening 104. Further, in some embodiments, pickup tube 64 and/or return tube 70 may pass through flow-through opening 104. In another example, pickup tube 64 and return tube 70 may pass through a single void together.

As shown in FIG. 1B, both voids 110 and 112 may be located at or near one of the perimeter surfaces of spacer 102. In the illustrated example, voids 110 and 112 may be located on the same perimeter surface of spacer 102. In other examples, voids 110 and 112 may be located on different perimeter surfaces. Further, voids 110 and 112 may not coincide with a perimeter surface. For example, voids 110 and 112 may be holes punched through a main body of spacer 102 without including a perimeter surface.

Turning to FIG. 1C, a cross sectional view of oil containment system 100 taken along line A-A of FIG. 1B is shown. Further, FIG. 1C illustrates the cross sectional view of system 100 in a tilt orientation. For example, as discussed above, such a scenario may be indicative of an extreme vehicle maneuver, such as a turn maneuver that may result in the oil level in a tilt orientation. In the illustrated example, the tilt orientation may be the result of a vehicle accelerating through a left turn on a banked ground surface angled at approximately 30 degrees from the horizontal, which is typical of racecar tracks. As such, a road surface supporting the vehicle may be angled at 30 degrees from the horizontal, wherein the angle is measured from a horizontal surface, parallel with a sea level of zero, for example. In this example, centripetal forces may lead to the oil being pushed towards the right side of the vehicle.

As shown, flow-through opening 104 may permit oil to flow over a top surface 114 of spacer 102 and return to suction region 82 via perimeter space 108. In other words, an outer surface of spacer 102 may be in fluidic communication with oil in the tilt orientation. In order to concentrate oil within the suction region, spacer 102 may have a substantial thickness so as to inhibit excessive volumes of oil from flowing away from suction region 82, as introduced above. For example, spacer 102 may have the dimensions 275×180×40 millimeters, wherein flow-through opening 104 may have the dimensions 175×85×40 millimeters. However, it will be appreciated that spacer 102 and likewise flow-through opening 104 may have other dimensions and the aforementioned length by width by height (thickness) dimensions are provided as one non-limiting example. In this way, spacer 102 may displace oil when the oil pan is in a tilt orientation in order to reduce the introduction of air into the pickup tube. Said in another way, spacer 102 may displace oil during an extreme vehicle maneuver and/or during an oil tilt orientation such that spacer 102 raises the oil level, thereby covering inlet 72 of the pickup tube with oil.

Since spacer 102 includes a flow-through opening 104 and forms a perimeter space 108 with the internal side surfaces of oil pan 62, a vehicle may make any maneuver and oil will be maintained within suction region 82. As such, oil may be directed through flow-through opening 104 in any direction, and thus contact any portion of top surface 114 to return to suction region 82 via perimeter space 108. In this way, spacer 102 may be in fluid communication with the oil in a tilt orientation but not in communication with a static oil level, as described above.

In some embodiments, spacer 102 may be hollow such that an internal void 116 of the spacer is not in fluidic communication with the oil regardless of the orientation of the oil. In other words, internal void 116 may be fluidically isolated from the oil within oil pan 62. A hollow spacer has the advantage of reducing the vehicle weight while achieving the same function as a solid spacer. In some embodiments, internal void 116 may include another type of material. For example, internal void 116 may be at least partially filled with an organic substance, an inorganic substance, a synthetic substance, a plastic-based material, a metal-based material, etc. In other embodiments, it may be desirable to include a spacer that is solid. Whether hollow or solid, spacer 102 may be made of a non-porous material such as a plastic composite, which is provided as one non-limiting example. As another non-limiting example, spacer 102 may be made of aluminum. It will be appreciated that spacer 102 may be made of aluminum sheet metal, and the volume of internal void 116 may be selected to enable fluidic communication via the above described pathway. Thus, the geometric dimensions of flow-through opening 104 and perimeter space 108 may be selected to enable oil to cycle around an outer surface of spacer 102 in order to maintain oil within suction region 82.

It will be appreciated that oil containment system 100 is provided by way of example and as such is not meant to be limiting. Rather, oil containment system 100 is provided so as to illustrate a general concept. As such, oil containment system 100 may provide a way to displace oil and maintain oil around an inlet of a pickup tube even during extreme vehicle maneuvers so as to reduce the potential for air bubbles to enter a downstream oil delivery passage.

It is to be understood that while FIG. 1A illustrates spacer 102 above static oil level 76, that other configurations are possible. For example, in some embodiments, spacer 102 may include a portion that is submerged in the static oil level.

Further, it will be appreciated that spacer 102 may be secured to one or more surfaces other than bottom surface 74. For example, spacer 102 may be secured to one or more internal side surfaces 84. Furthermore, spacer 102 may be mounted to a surface other than a surface of oil pan 62. For example, spacer 102 may be secured to one or more bearing beams and/or bearing caps. Said in another way, spacer 102 may be an integral expansion of a bearing beam and/or a bearing cap of the engine. In this way, spacer 102 may be mounted from above, such as to a portion of the engine located vertically above top surface 114 via an expanding bearing beam, for example. As such, it will be appreciated that spacer 102 may be mounted to the engine such that the spacer is located outside of the oil pan. Further, in some embodiments spacer 102 may be mounted such that spacer 102 is flush with one or more internal side surfaces of oil pan 62. As one example, spacer 102 may be flush with each internal side surface such that the spacer is mounted to the entire perimeter of the oil pan. In such an example, a perimeter space between spacer 102 and the oil pan would be absent.

Further, it will be appreciated that spacer 102 may be of any suitable geometric size and shape without departing from the scope of this disclosure. FIGS. 1A-1C depict spacer 102 as a generally rectangular structure with a void through a main body 118 of the spacer. As described above, the void (e.g., flow-through opening) creates a frame-like spacer configuration. In other words, the spacer may include outer perimeter surfaces 106 and inner perimeter surfaces 120. In this way, a top surface and a bottom surface of spacer 102 may be coupled via outer and inner perimeter surfaces. As shown, perimeter surfaces 106 and 120 may define geometries with concentric centers. While the perimeter surfaces may be associated with a common centroid, it will be appreciated that the perimeter surfaces may define geometries that do not share a common centroid. In other words, the perimeter surfaces may be shifted from the illustration as shown in FIG. 1B.

Further, it will be appreciated that oil containment system 100 may include additional or alternative components than those depicted in FIGS. 1A-1C. For example, an oil containment system may additionally or alternatively include another spacer, and/or one or more baffle plates to further displace and direct oil flow during extreme vehicle maneuvers and maintain oil around a suction region associated with a general vicinity around the pickup tube inlet.

For example, FIGS. 2A-2B illustrate an oil containment system 200 including a spacer 202. FIG. 2A shows the oil containment system 200 during normal vehicle operations (e.g., during normal vehicle maneuvers), such that a static oil level 76 is maintained vertically below spacer 202, similar to spacer 102 of FIG. 1A. FIG. 2B shows the oil containment system 200 in a tilt orientation, similar to the scenario described with respect to FIG. 1C. For example, the oil level may be in a tilt orientation as a result of an extreme turn maneuver. It will be appreciated that some features of FIGS. 2A-2B are similar to those of FIGS. 1A-1C and are therefore indicated with common reference numbers. Such features will not be discussed repetitively.

For simplicity of illustration, FIGS. 2A-2B do not show spacer 102, however it will be appreciated that oil containment system 200 may include spacer 102 in addition to spacer 202. In such examples, spacer 202 may be positioned vertically above top surface 114 of spacer 102. In other words, spacer 202 may be secured to a side wall between spacer 102 and the overhead rotating components (e.g., crankshaft 40).

Referring to FIG. 2A, spacer 202 may be secured to an interior side wall 84 of oil pan 62. As shown, spacer 202 may be secured to interior side wall 84 with some clearance to allow oil to flow about all sides of spacer 202, including a space between spacer 202 and interior side wall 84. Spacer 202 may be secured to interior side wall 84 with bolts, for example. In another example, spacer 202 may be mounted flush to interior side wall 84. Similar to spacer 102, spacer 202 may be positioned above static oil level 76. Further, spacer 202 may be positioned vertically below rotating components housed within the wet sump crankcase. For example, spacer 202 may be positioned vertically below a crankshaft (not shown). Said in another way, spacer 202 may be positioned between a static oil level and the crankshaft such that spacer 202 is not in communication with the crankshaft or the static oil level during normal engine operations.

As shown, spacer 202 may be generally rectangular in shape. In other examples, spacer 202 may have a more rounded geometry. Further, spacer 202 may include extensions coupled to a main body, wherein the extensions are continuous with the main body. In other words, spacer 202 may be any regular or irregular shape without departing from the scope of this disclosure. Furthermore, it will be appreciated that spacer 202 may occupy a geometric volume of substantial dimensions so as to displace oil in tilt orientations which may occur due to vehicle maneuvers and/or due to vehicles traveling over inclined (tilted) surfaces. For example, spacer 202 may have a geometric volume of approximately 1 liter, and as such may have the dimensions 160×120×60 millimeters, which is provided as one non-limiting example. Since spacer 202 is positioned above static oil level 76, the size of spacer 202 may be relatively large and occupy a volume substantially greater than traditional solutions without raising the static oil level during normal vehicle maneuvers, as described above. Further, spacer 202 may be hollow similar to spacer 102. In this way, an internal void 204 of spacer 202 may not be in fluidic communication with the oil regardless of the engine operating condition, similar to spacer 102.

As shown, oil containment system 200 may further include one or more baffle plates 206 to direct oil towards suction area 82. In other words, the one or more baffle plates 206 may direct oil flow to inlet 72 of the pickup tube. As shown, baffle plates 206 may have a step-like configuration to channel oil in a cascading fashion towards inlet 72. In another example, oil baffles 206 may have an inclined surface to channel oil towards inlet 72 in a sliding fashion. It will be appreciated that baffle plates 206 may form another suitable shape so as to direct oil flow towards inlet 72.

Further, oil pan 62 may include a deep sump portion 208 and a shallow sump portion 210. Deep sump portion 208 may result in a deeper oil depth as measured from static oil level 76, and shallow sump portion 210 may result in a more shallow oil depth as measured from static oil level 76. As shown, inlet 72 may be positioned substantially close to a bottom surface of deep sump portion 208. In this way, oil may be maintained within suction region 82 by maintaining oil within deep sump portion 208.

Referring to FIG. 2B, oil containment system 200 is shown in a tilt orientation as a result of an extreme turn maneuver, similar to the above description for FIG. 1C. As shown, during an extreme vehicle maneuver such as a left turn around a 30 degree banked road surface, oil may be directed towards the right side of oil pan 62 due to centripetal forces. It will be appreciated that the oil level may be tilted with respect to the bottom surface of oil pan 62 due to various different scenarios. An oil level may be tilted due to a vehicle maneuver and/or due to vehicles traveling over inclined (tilted) surfaces, for example.

In this example, spacer 202 may displace oil such that fluid communication between inlet 72 and the oil is maintained. Said in another way, spacer 202 may displace oil during an extreme vehicle maneuver and/or during an oil tilt orientation such that spacer 202 raises the oil level, thereby covering inlet 72 of the pickup tube with oil. In order to concentrate oil within the suction region, spacer 202 may have a substantial thickness (e.g., 60 millimeters) so as to inhibit excessive volumes of oil from flowing away from suction region 82, as described above. In this way, spacer 202 may displace oil when the oil level is in a tilt orientation in order to reduce the introduction of air into pickup tube 64.

It will be appreciated that oil containment system 200 is provided by way of example and as such is not meant to be limiting. Rather, oil containment system 200 is provided to illustrate a general concept of maintaining fluid communication between inlet 72 and the oil even during extreme vehicle maneuvers. As such, configurations other than those illustrated are possible without departing from the scope of this disclosure.

For example, oil containment system 200 may include more than one spacer 202. Further, oil containment system 200 may include a spacer 202 to be secured to each internal side surface of oil pan 62. In this way, oil may be tilted in other directions and each spacer may be positioned such that oil is maintained within suction region 82 regardless of the direction a centripetal force, a gravitational force, or another force pushes or pulls the oil.

In some embodiments, an oil containment system may include a first spacer and a second spacer. For example, an oil containment system may include spacer 102 and one or more spacers 202. In such an example, one or more spacers 202 may be positioned vertically above spacer 102, as described above.

It is to be understood that while FIG. 2A illustrates spacer 202 above static oil level 76, that other configurations are possible. For example, in some embodiments, spacer 202 may include a portion that is submerged in the static oil level.

Further, it will be appreciated that spacer 202 may be secured to one or more surfaces other than internal side surface 84. For example, spacer 202 may be secured to bottom surface 74. Furthermore, spacer 202 may be mounted to a surface other than a surface of oil pan 62. For example, spacer 202 may be secured to one or more bearing beams and/or bearing caps. In this way, spacer 202 may be mounted from above, such as to a portion of the engine located vertically above a top surface of spacer 202 via a bearing beam, for example. Further, in some embodiments spacer 202 may be mounted such that spacer 202 is flush with one or more internal side surfaces of oil pan 62.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system for an engine comprising:

an oil pan;

a pickup tube; and a spacer positioned vertically above a static oil level including an internal void between an internal wall of a top surface and an internal wall of a bottom surface of the spacer and a flow-through opening positioned vertically above an inlet of the pickup tube, a perimeter of the spacer adjacent and spaced away from interior side walls of the oil pan to form a perimeter space, the spacer secured to a bottom surface of the oil pan, below the static oil level.

2. The system of claim 1, wherein the internal void of the spacer is fluidically isolated from oil in the oil pan, and wherein the spacer is a hollow spacer.

3. The system of claim 1, wherein a cross-sectional area of the flow-through opening is greater than a cross-sectional area of the perimeter space, and wherein the spacer is a solid spacer.

4. The system of claim 1, wherein the spacer is secured to the bottom surface of the oil pan via one or more vertical run down bolts, the bolts pass through the bottom surface of the spacer proximate to a corner of the spacer.

5. The system of claim 1, wherein the flow-through opening is surrounded by vertical walls of the spacer.

6. The system of claim 1, wherein a dipstick is in communication with the static oil level and the spacer is positioned above the static oil level.

7. The system of claim 1, wherein the spacer displaces oil when oil is in a tilt orientation to maintain oil around the inlet of the pickup tube by raising an oil level in order to reduce air in an oil delivery passage, the oil delivery passage in fluidic communication with the pickup tube.

8. The system of claim 7, wherein an outer surface of the spacer communicates with the oil in the tilt orientation.

9. The system of claim 8, wherein the flow-through opening permits oil to flow over the top surface of the spacer and return to a suction region of the oil pan via the perimeter space when in the tilt orientation.

10. The system of claim 1, wherein the pickup tube and a return tube include portions that pass under the spacer and other portions that pass vertically adjacent to the interior side walls of the oil pan, the pickup tube and the return tube passing through separate voids of the spacer and not passing through the flow-through opening.

11. The system of claim 1, wherein the spacer includes inner perimeter surfaces that define the flow-through opening and outer perimeter surfaces, the outer perimeter surfaces defining one or more voids for the pickup tube and a return tube, the outer perimeter surfaces and the interior side walls defining the perimeter space, and the outer perimeter surfaces and inner perimeter surfaces defining geometries with concentric centers.

12. The system of claim 11, wherein the top surface and the bottom surface of the spacer are coupled via the inner and outer perimeter surfaces, the pickup and return tubes passing below the bottom surface extending through the one or more voids and above the top surface.

13. The system of claim 1, wherein the spacer is a first spacer, the oil pan further coupled to a second spacer secured to an interior side wall of the oil pan vertically above the first spacer.

14. A system for an engine comprising:

an oil pan;

a suction tube;

one or more baffle plates; and a hollow spacer including a fluidically isolated internal void between top and bottom internal walls of respective top and bottom surfaces of the spacer, the spacer secured to an interior side wall of the oil pan and positioned vertically above a static oil level and below rotating components housed within a wet sump crankcase.

15. The system of claim 14, wherein the one or more baffle plates direct oil flow to an inlet of the suction tube, and wherein the spacer is adjacent to and contiguous with a wall of the oil pan.

16. The system of claim 14, wherein the hollow spacer concentrates oil to a suction region coinciding with an inlet of the suction tube when the oil is in a tilt orientation.

17. A system for an engine comprising:

an oil pan;

a pickup tube;

a dipstick in communication with a static oil level;

a hollow spacer secured to the oil pan and positioned between the static oil level and rotating components housed within a wet sump crankcase; and an internal void of the hollow spacer fluidically isolated from the static oil level, the internal void positioned between top and bottom internal walls of respective top and bottom surfaces of the hollow spacer.

18. The system of claim 17, further including one or more baffle plates to direct oil flow to an inlet of the pickup tube.

19. The system of claim 17, where in the hollow spacer includes a flow-through opening.

20. The system of claim 17, wherein the hollow spacer is secured to a side wall of the oil pan such that an outside surface of the hollow spacer is flush with the side wall.

* * * * *